United States Patent [19]

Ishida et al.

[11] Patent Number: 4,934,463

[45] Date of Patent: Jun. 19, 1990

[54] AUTOMATIC IMPLEMENT POSITION CONTROL SYSTEM

[75] Inventors: Shuji Ishida, Tokyo; Shoji Tozawa, Kobe; Shunji Asao, Kanagawa; Masashi Musha, Kobe; Kenichi Yamamoto, Kanagawa; Kazuhiko Eigetsu, Sagamihara; Kyoichi Oguri, Hino; Izuru Morita, Hachioji; Yasunori Matsunaga; Naoto Kozuki, both of Sagamihara; Shinichi Amemiya, Atsugi, all of Japan

[73] Assignee: Caterpillar Inc., Peoria, Ill.

[21] Appl. No.: 424,312

[22] PCT Filed: Jan. 25, 1989

[86] PCT No.: PCT/US89/00310

§ 371 Date: Aug. 7, 1989

§ 102(e) Date: Aug. 7, 1989

[87] PCT Pub. No.: WO89/07177

PCT Pub. Date: Aug. 10, 1989

[30] Foreign Application Priority Data

Jan. 27, 1988 [JP] Japan ..... 63-016764

[51] Int. Cl.[5] ..... E02F 3/76

[52] U.S. Cl. ..... 172/4.5; 172/812; 172/821

[58] Field of Search ..... 172/2, 4.5, 811, 812, 172/819–826, 828, 830, 831; 60/484

[56] References Cited

U.S. PATENT DOCUMENTS

| | | | |
|---|---|---|---|
| 4,024,796 | 5/1977 | Theobald | 91/411 |
| 4,166,506 | 9/1979 | Tezuka et al. | 172/4.5 |
| 4,194,365 | 3/1980 | Stoufflet et al. | 60/468 |
| 4,282,933 | 8/1981 | Suganami et al. | 172/4.5 |
| 4,288,196 | 9/1981 | Sutton, II | 172/4.5 X |
| 4,431,060 | 2/1984 | Scholl et al. | 172/4.5 |
| 4,537,259 | 8/1985 | Funabashi et al. | 172/4.5 |

FOREIGN PATENT DOCUMENTS

| | | |
|---|---|---|
| 62-45838 | 2/1987 | Japan . |
| 62-24579 | 5/1987 | Japan . |

*Primary Examiner*—Randolph A. Reese
*Assistant Examiner*—Jeffrey L. Thompson
*Attorney, Agent, or Firm*—Robert E. Muir

[57] ABSTRACT

It takes high skill to achieve maximum efficiency of construction equipment under the ever changing working conditions. The automatic implement control system helps maximize operator efficiency and convenience by allowing a predetermined angle, lift and/or tilt position of a work implement (40) to be stored in the memory of the controller (3). In operation, the implement (40) may be moved from that stored predetermined position to perform other functions. In an automatic mode, the controller (3) can return the implement (40) to that predetermined position at any time during the work cycle. A valve (15–70) is provided for selectively switching between manual and automatic modes.

10 Claims, 5 Drawing Sheets

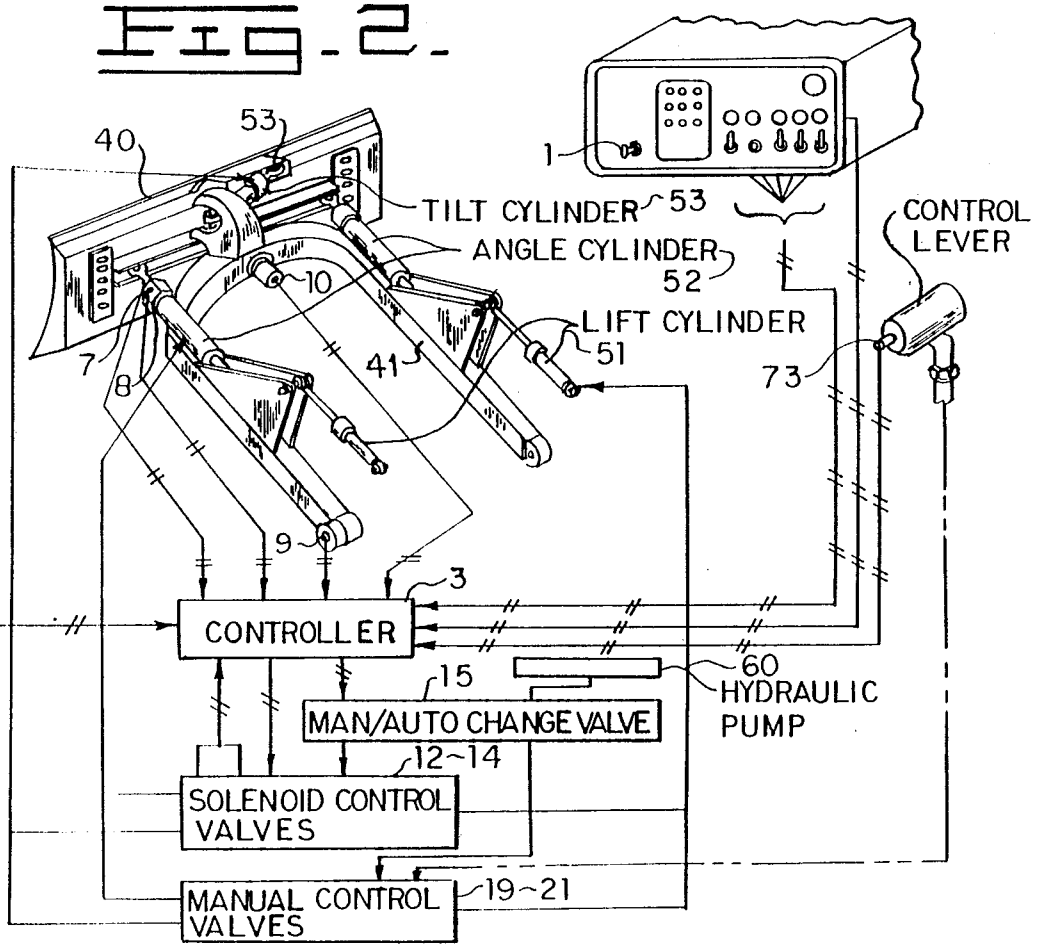
FIG. 2.
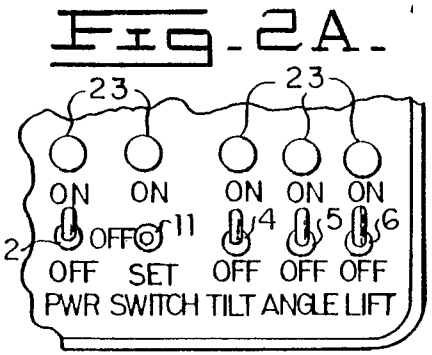
FIG. 2A.
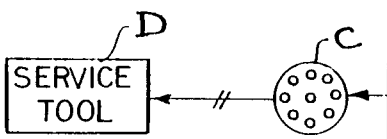

START
S-1
ENGINE START ON?
NO
YES
S-2
AUTO-RETURN IN OPERATION?
YES
NO
S-3
MEMORY POSITION RECEIVED?
NO
YES
S-4
CHANGEOVER VALVE MANUAL MODE
S-5
A SELECTIVE SWITCH ON?
NO
YES
S-6
AUTO-RETURN SWITCH ON?
NO
YES

AUTOMATIC IMPLEMENT POSITION CONTROL SYSTEM

TECHNICAL FIELD

This invention relates generally to the positioning of a work implement in construction equipment and more particularly to an automatic implement position control system.

BACKGROUND ART

Manual hydraulic control circuits and cable control systems for buckets, rippers, blades, and other work implements are commonly employed within construction equipment used today. For example, an operator has to adjust the height, angle, and the tilt of the bulldozer blade at the beginning of every dozing operation. With each repositioning of the implement, the overall efficiency of the operation is decreased.

Automatic blade control systems using lasers have been proposed. However, such a system is not practical in earthmoving equipment because of the severe operating conditions.

One prior art example of a hydraulic motor control system is shown in U.S. Pat. No. 4,194,365 to Stoufflet et al issued Mar. 25, 1980. In this system, a single valve is selectively operated in either an automatic mode or a manual mode. A controller automatically regulates the return of the turret of a hydraulic excavator to a desired stopping position by taking into consideration the kinetic energy of the rotating turret.

A known automatic blade positioning device is shown in Japanese Patent Publication No. (Sho 62-24579) to Kabushiki Kaisha Komatsu Seisakusho issued May 29, 1987. In this arrangement, the blade is automatically controlled by detecting the difference of the rotational angle of two lift cylinders. This system uses the vehicle frame as its reference and the blade position can be repositioned only with respect to the frame.

The number of tasks in earthmoving operations have greatly increased and often distract from overall efficiency. The operator's view is often obstructed by the implement and is subject to parallax. Thus considerable time can be spent in repositioning an implement.

The present invention is directed to overcome one or more of the problems set forth above.

DISCLOSURE OF THE INVENTION

In one aspect of the invention there is provided an automatic implement position control system which includes manually and electrically actuatable control valve means connected between a hydraulic pump and a hydraulic motor. A manually actuatable changeover valve selectively changes the flow of hydraulic fluid from one of the control valve means to the other to change between manual and automatic modes. A controller stores a base signal and receives an active signal from a position sensor. It compares the signals and sends a resulting control order to the electrically actuatable control valve means to locate the hydraulic motor to a preselected displacement.

Advantageously, the manually actuatable control valve means and the electrically actuatable control valve means are connected in parallel to said hydraulic motor and operate independently of one another.

In one arrangement the automatic implement control system allows the operator to select a preselected position of the tilt, angle and lift of a bulldozer blade, and upon movement of the blade, return it to the original tilt, angle, and/or lift position. In this manner, the efficiency of operation is significantly increased because the constant task of repositioning the implement to a desired location is alleviated. Further, this enables the quality of a given operation to also be improved.

BRIEF DESCRIPTION OF THE DRAWINGS

FIG. 2 is a diagram, partly schematic and partly block, showing the system applied to a bulldozer blade;

FIG. 2A is an enlarged view of a portion of the control panel shown in FIG. 2;

BEST MODE FOR CARRYING OUT THE INVENTION

Figure 1:
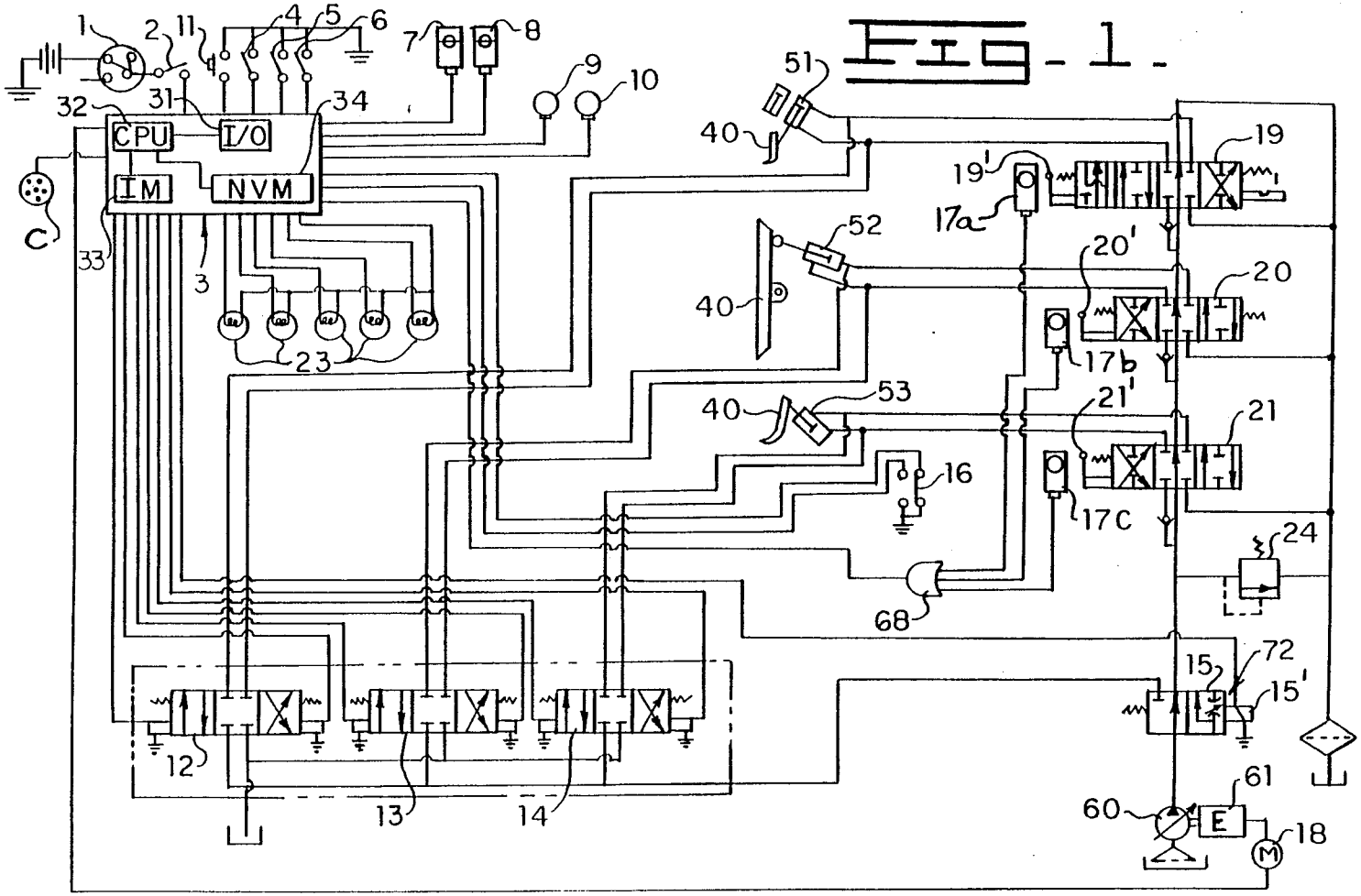
FIG. 1 is a circuit diagram illustrating one embodiment of an automatic implement position control system.

FIG. 1 shows an automatic implement control system for the positioning of a work implement. The implement is illustrated as a conventional bulldozer blade 40; however, it is understood that any implement may be used. The various adjustments of the blade 40 are controlled by hydraulic motors; e.g. blade lift is controlled by a hydraulic ram 51, angular displacement is determined by a hydraulic ram 52, and tilt of the blade is controlled by hydraulic ram 53. First, second and third manually actuatable control valves 19 to 21 are operatively connected to their respective lift, angular, and tilt hydraulic rams or motors 51 to 53. Thus, with the use of manual control levers 19' to 21', the operator has independent control of the hydraulic rams 51 to 53 for simultaneous lifting, angling, and tilting of the blade 40.

A hydraulic pump 60 draws fluid from a tank 25 and supplies pressurized fluid through a conduit to the respective first, second, and third manual control valves 19 to 21, which communicate with the tank by way of a return line. A relief valve 24 is located between the hydraulic pump 60 and the manual control valves 19 to 21 and is set to open at a predetermined pressure to relieve the system of excessive pressure. The hydraulic pump 60 is driven by an engine 61. To start the engine, an engine starting motor 18 is provided between it and a key-start switch 1. Thus, when the key-start switch is turned to the "start" position, the engine starting motor 18 begins to run and starts the engine 61.

A controller 3 is electrically connected to a plurality of indicator lamps 23, position sensors 7 to 10 and 17*a* to 17*c*, selective switches 4 to 6, a set switch 11, and a controller electric supply switch 2. The controller 3 has an Input/Output (I/O) 31 for sending and receiving signals, a microprocessor 32 for performing calculations between the actual and preselected positions, an internal memory (IM) 33 for temporary storage and a non-volatile memory (NVM) 34 for more permanent storage.

A connector C is provided for connecting a trouble-shooting device D (e.g. a hand held computer, service tool, etc.) to the controller 3. Thus abnormal operation of the overall system and/or individual components can be easily serviced.

As best seen in FIG. 2A, selective switches 4 to 6 are two-way toggle switches used for activating their respective lift, angle, and/or tilt return functions in an automatic mode. The five indicator lamps 23 are conveniently mounted above a power switch 2, a set switch 11, and the three selective switches 4 to 6. Each of these indicator lamps 23 are lighted when their respective switches are turned to the "on" position. The key-start switch 1, controller electric supply switch 2, first to third selective switches 4 to 6, and set switch 11 are positioned on a control panel located within a cab of a construction machine.

Referring to FIG. 2, there are four position sensors 7 to 10, that locate various positions of the blade 40 with respect to the construction machine. A base signal, corresponding to a preselected displacement of each respective hydraulic ram 51,52,53, may be set in the controller 3 when the system is in a manual mode. Similarly, active signals, corresponding to the positions of the hydraulic rams are fed to the controller in the automatic mode. Position sensors 9 and 10 are potentiometers located to detect the vertical and tilting movement of the bulldozer blade 40, respectively. Lift position sensors 9 are mounted on the joints between the C-frame 41 and the construction machine. Tilt position sensor 10 is mounted on the joint between C-frame 41 and the bulldozer blade 40. The angle of the blade 40 is determined by two non-contact position sensors 7, 8 located on their respective hydraulic rams 52. To analyze the position of the blade 40 via the potentiometers, resistance readings are mathematically converted to directly correspond to the values of blade height and the blade tilting angle. Digital rotating angle sensors, such as a rotary encoder, may be used instead of potentiometers.

A set switch 11 is provided for actuating the position sensors to transport the positional data into a non-volatile memory 34.

Movement detection sensors 17*a* to 17*c* are each positioned to detect any movement of their respective control lever 19, to 21, The movement detection sensors 17*a* to 17*c* are connected to the input of an OR gate 68, the output of which is connected to the controller 3. The function of the OR gate 68 is to send a positive signal to the controller 3 upon movement of the lift control lever 19'; of the angle control lever 20'; or of the tilt control lever 21'. This positive signal is processed by the controller to move a changeover valve 15 (hereafter described) from an automatic mode to a manual mode.

First, second, and third electrically actuatable control valves 12 to 14, wholly separate from manually actuatable control valves 19 to 21, are disposed between the hydraulic pump 60 and their respective lift, angular, and tilt hydraulic rams 51 to 53. They are also independently connected to the controller 3 and responsive to control signals received from the output of the I/O 31.

The changeover valve 15 receives pressurized fluid from the hydraulic pump 60 and is arranged to direct that fluid to either the electronically actuatable control valves 12 to 14 or the manually actuatable control valves 19 to 21. Changeover valve 15 has a solenoid 15' which is electronically connected to the controller 3. The solenoid 15' is thereby controlled to move the changeover valve 15 from the manual mode to the automatic mode as described above.

When the changeover valve is the position illustrated in FIG. 1, it is in the manual mode and pressure is directly sent to the manually actuated control valves 19 to 21. However, when the operator presses an automatic return button 73, the automatic mode is activated by the controller 3, and fluid is directed to both the manual and automatic control valves. Note, however, that while the fluid flows to the automatic control valves 12 to 14 for operation thereof during this automatic mode, the alternate path of fluid is initially impeded by an orifice 72 and then flows to manually actuated control valves 19 to 21 to permit manual operation. Note that manual operation takes precedence over automatic operation even in the automatic mode; i.e. there is a selective manual override in the automatic mode.

Referring to FIG. 2, the automatic return button 73 is located on one of the control levers 19' to 21' and activates an automatic control switch 16 which is electronically connected to the controller, as shown in FIG. 1. Together the automatic controls send an electronic signal to the controller to actuate the automatic mode of the valve 15.

Figures 3, 3A:
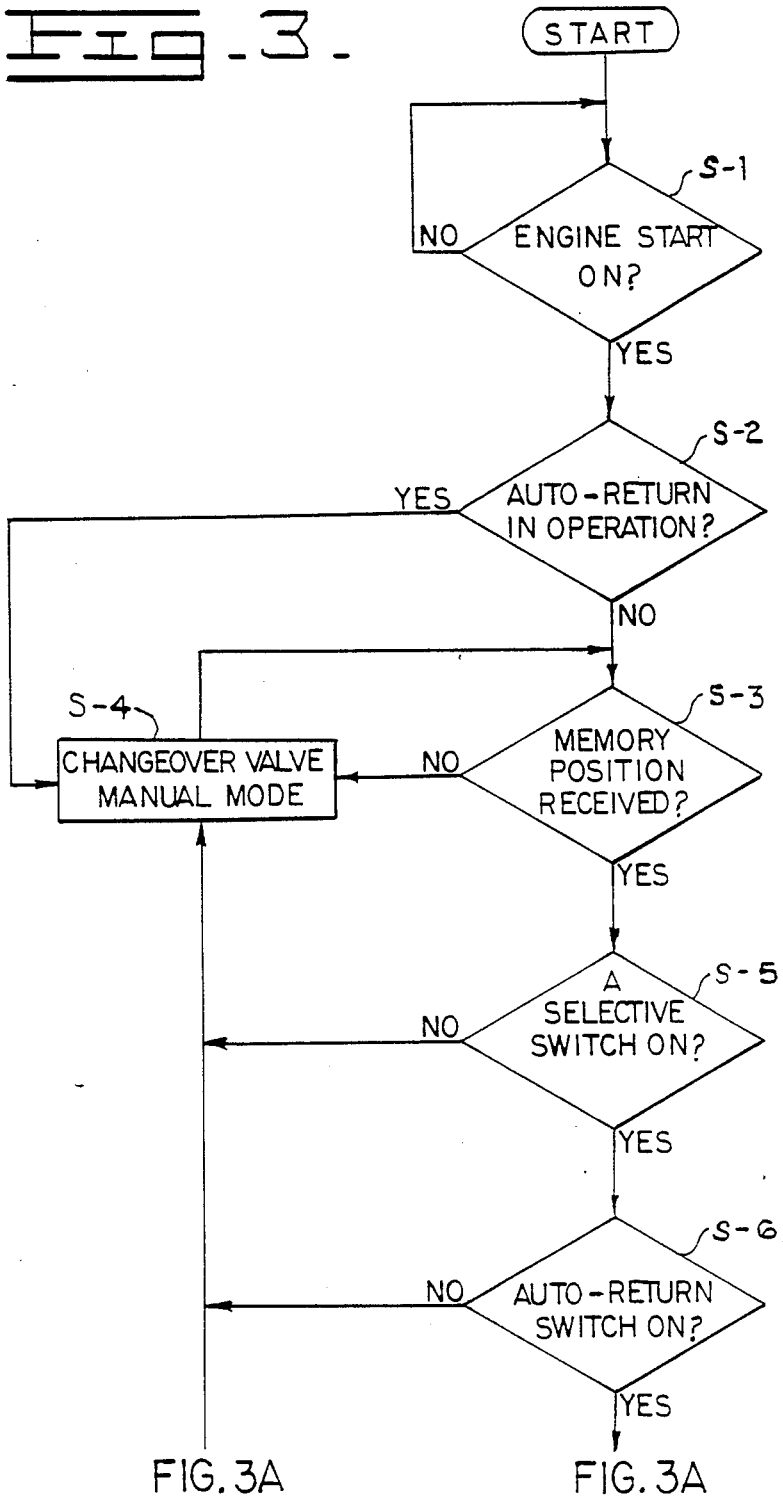
FIGS. 3 & 3A together are a flow diagram of the automatic operation of the system.
Figure 3A:
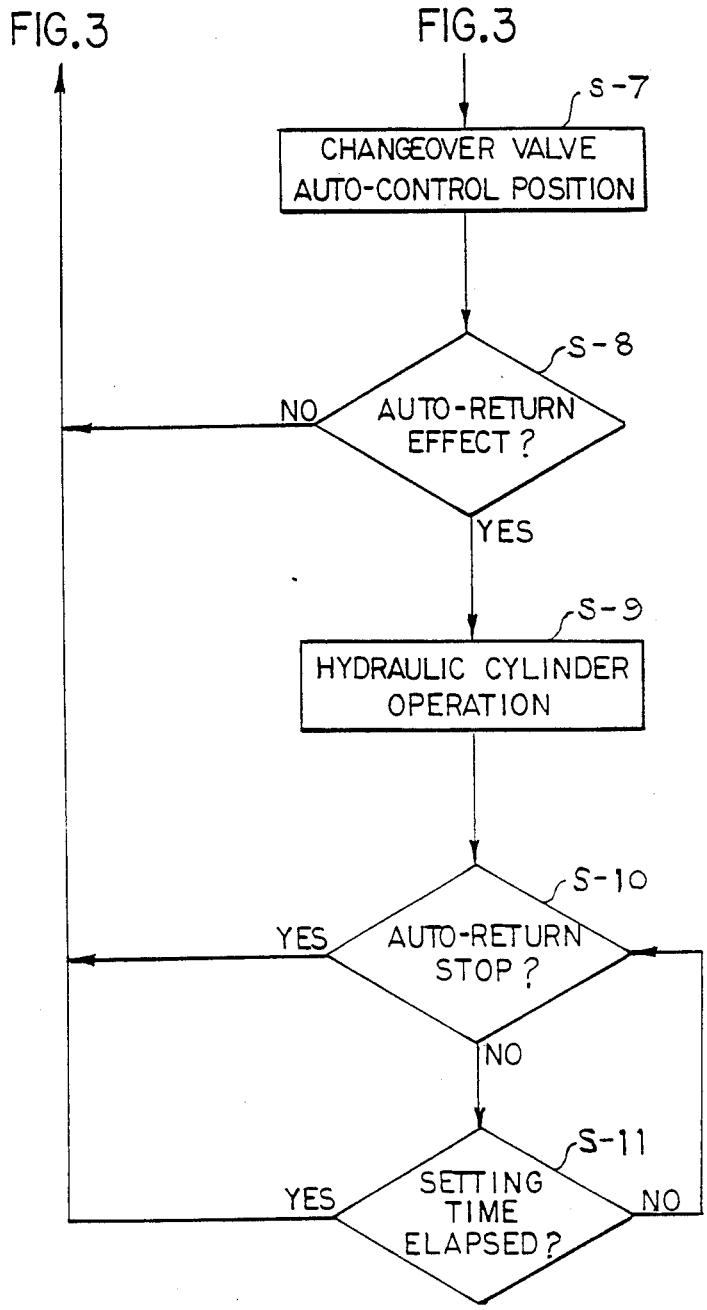

Referring now to FIGS. 3 & 3A wherein the various steps are indicated by the prefix "S", the overall operation of the automatic implement position control system is explained as follows:

Step 1 - the key start switch 1 is turned "on," and the engine is started;

Step 2 - a safety step in which the controller 3 checks to see if the automatic control valves 12 to 14 are in operation and, if they are in operation, the controller 3 sends a signal to the changeover valve 15 to switch the changeover valve 15 to the manual mode;

Step 3 - the non-volatile memory 34 is checked to see if locational data (i.e. a base signal) has been stored, if nothing has been saved the manually actuatable control valves 19 to 21 are activated;

Step 4 - when in the manual mode, the controller 3 constantly searches the non-volatile memory 34 to see if positional data has been stored;

Step 5 - the selective switches (toggles) 4 to 6 are checked to see if any of the three (lift, tilt, and/or angle) are in the "on" position and, if they are all in the "off" position, the manual mode is actuated;

Step 6 - the controller 3 searches to see if the automatic return button 73 has been pressed to actuate the automatic return mode; if the automatic return switch 16 is not "on," the manual mode is actuated;

Step 7 - the changeover valve 15 is directed to the automatic control position upon actuation of the set switch 11, one of the selective switches 4 to 6, and the actuation of the automatic return switch 16;

Step 8 - the lift, tilt, and angle selective switches are checked by the controller 3 to see if they are "on" so their corresponding automatic return effect for the lift, tilt, and/or angle can be actuated, if they are all "off," the valve 15 switches to the manual mode;

Step 9 - the corresponding lift, tilt, and/or angle hydraulic cylinders 51 to 53 are actuated in the automatic mode to return to their predetermined location stored in the non-volatile memory 34;

Step 10 - the controller 3 searches to see if the automatic return effect of the implement 40 is still in operation, if it's not in operation the manual mode of valve 15 is actuated;

Step 11 - the controller 3 compares the elapsed time of the automatic return effect with the predetermined interval for the entire automatic return effect, if the current time interval is equal to or greater than the predetermined time interval, the manual mode is automatically triggered; however, if the current time interval is less than the predetermined time interval, step 10 is repeated.

Figure 4:
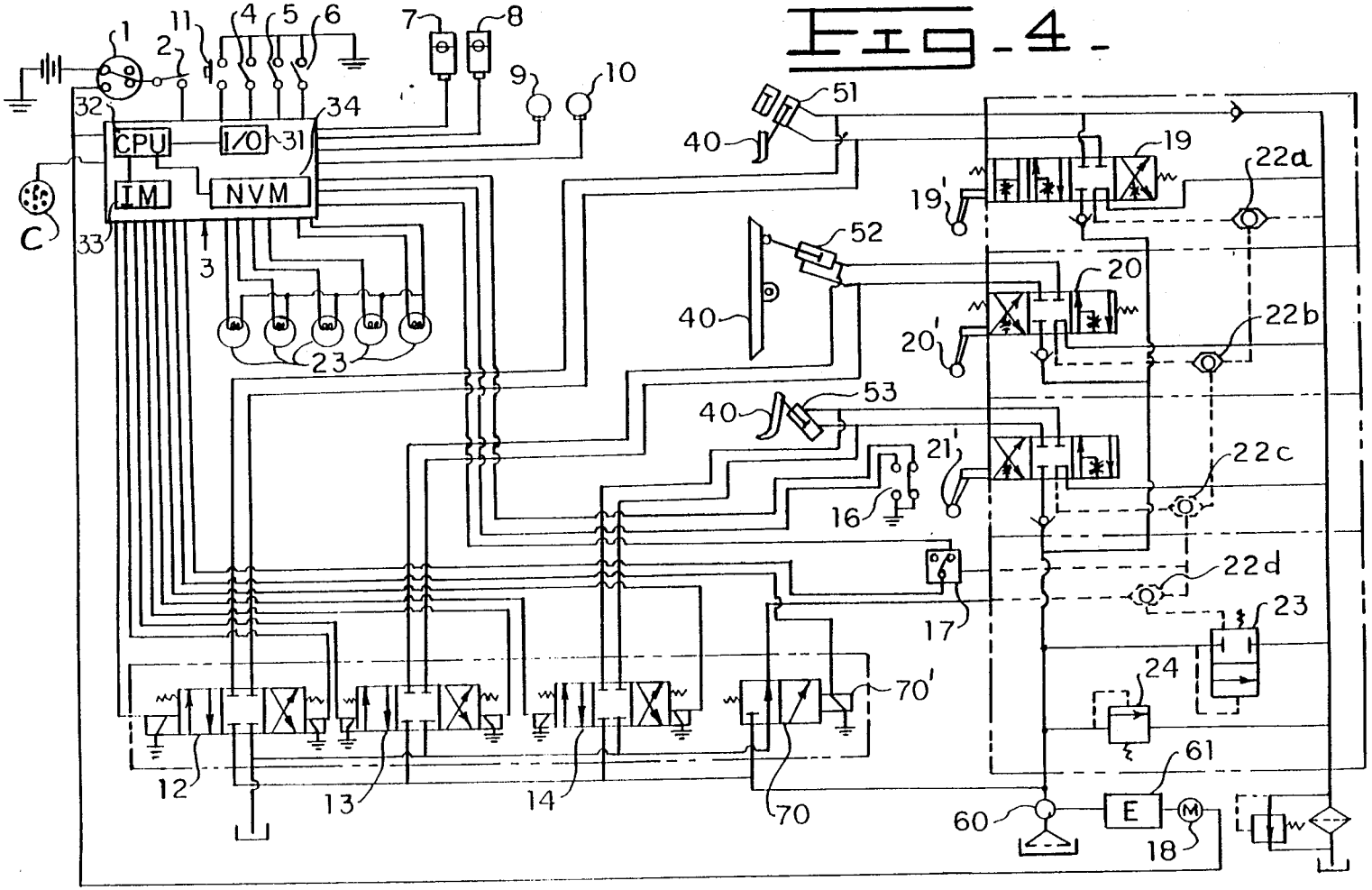
FIG. 4 is a circuit diagram illustrating an alternate embodiment of the system.

Referring now to FIG. 4, another embodiment of the present invention is illustrated. Like components have like numerals while similar and additional components have different numerals attached thereto. Resolvers 22*a* to 22*d* detect back pressure increases when one or all of the first to third manual control valves 19 to 21 are operated. When one of the resolvers 22*a* to 22*d* senses manual operation, a pressure switch 17 is actuated to send a signal to controller 3 which controls a solenoid 70' to return a changeover valve 70 to the manual position shown. Accordingly, when one of the manual control levers 19' to 21' is operated, the appropriate resolver 22*a* to 22*c* is opened which generates enough pressure to trigger the pressure switch 17, automatic control valves 12 to 14 returns to the neutral position shown, and changeover valve 70 returns to the manual mode to allow the fluid to flow to the manually actuatable control valves 19 to 21. When the changeover valve 70 is in the automatic mode, fluid pressure is sent to the resolver 22*d* and to the automatic control valves 12 to 14.

A bypass valve 23 works in conjunction with the changeover valve 70. When the changeover valve 70 is in the automatic mode, pressurized fluid is sent through the resolver 22*d* and to the bypass valve 23. The pressure of the fluid then acts on the spring of the bypass valve 23 and closes the conduit line. Thus, all of the fluid displaced from the hydraulic pump 60 is directed to the electronically actuatable control valves 12 to 14. This generates enough pressure to actuate the abovementioned control valves.

Industrial Applicability

In the embodiments described, a control system is used in conjunction with a plurality of position sensors to allow the storage of the work implement location data or base signal. Any single or combination of an angle, tilt, or lift position can be stored and recalled at any time during vehicle operation. Thus, by having an automatic implement control system, the efficiency of an operation is significantly increased because the constant task of repositioning the implement to a desired location is alleviated. This feature also eliminates the constant need to manually repositioning the work implement to a desired location. This will lead to the ergonomic advantage of decreased operator fatigue because without the constant worry of repositioning the implement to a specific location, the operator will incur less stress on the job.

Other aspects, objects, features and advantages can be obtained from a study of the drawings, the disclosure and the appended claims.

We claim:

1. An automatic implement position control system for a work implement (40) of a construction machine having a hydraulic pump (60) and a hydraulic motor (51-52-53), comprising:

a manually actuatable control valve (19-20-21) connected between the hydraulic pump (60) and the hydraulic motor (51-52-53) for controlling operation of the hydraulic motor (51-52-53) in a manual mode;

an electrically actuatable control valve (12-13-14) connected between the hydraulic pump (60) and the hydraulic motor (51-52-53) for controlling operation of the hydraulic motor (51-52-53) in an automatic mode, the electrically actuatable control valve (12-13-14) being connected in parallel with said manually actuatable control valve (19-20-21) for independent operation independently thereof;

position sensor means (7,8-9-10) for sending an active signal correlative to a position of the hydraulic motor (51-52-53);

control means (3) for storing a base signal corresponding to a preselected displacement of the hydraulic motor (51-52-53) in said manual mode, for selectively receiving said active signal in said automatic mode, and for comparing said signals for sending a resulting control order to said electrically actuatable control valve (12-13-14) to locate the hydraulic motor (51-52-53) to the preselected displacement; and manually actuatable valve means (15,70) for selectively changing flow of hydraulic fluid from one of said control valves (19-20-21, 12-13-14) to the other to change from one mode to the other and vice versa.

2. An automatic implement position control system as recited in claim 1, including a relief valve (24) connected to said hydraulic pump (60) for monitoring a load pressure and controlling the pump (60) discharge pressure in response to the load pressure.

3. An automatic implement position control system as recited in claim 1, in which the manually actuatable control valve (19-20-21) includes a manual control lever (19'-20'-21'), and including a pressure switch (17) and a resolver (22*a*-22*b*-22*c*-22*d*) which together are responsive to back pressure from said hydraulic pump (60) for immediately changing from the automatic mode to the manual mode when the manual control lever (19'20'21') is moved.

4. An automatic implement position control system as recited in claim 1, wherein said hydraulic motor (51-52-53) includes lifting, tilting, and angular hydraulic cylinders (51-52-53).

5. An automatic implement position control system as recited in claim 1, in which the controller (3) has a non-volatile memory (34), and including a set switch (11) which activates delivery of the base signal to the controller (3) to store the preselected displacement of the hydraulic motor (51-52-53) data in the non-volatile memory (34).

6. An automatic implement position control system as recited in claim 1, wherein the position sensor means (7,8-9-10) comprise an implement lift detecting sensor (9), an implement angling degree detecting sensor (7,8) and an implement tilting degree detecting sensor (10).

7. An automatic implement position control system as recited in claim 1, including a manual control lever (19'-20'-21') having a movement detection sensor (17*a*-17*b*-17*c*) which activates the manual mode of said valve means (15,70).

8. An automatic implement position control system as recited in claim 1, wherein the hydraulic motor (51-52-53) has a variable displacement, and the position sensor means (7,8-9-10) is a potentiometer having a variable resistance correlative to said variable displacement.

9. An automatic implement position control system for a vehicle having a work implement (40), a hydraulic ram (51-52-53) for moving the implement (40), and a source of hydraulic pressure (60), the control system, comprising:

a manually operated control valve (19-20-21) connected between the pressure source (60) and the hydraulic ram (51-52-53) for controllably extending and retracting the hydraulic ram (51-52-53) in a manual mode;

position sensor means (7,8-9-10) for detecting the longitudinal displacement of the hydraulic ram (51-52-53)and providing an active signal corresponding to such position;

an electrically operated control valve (12-13-14) separately connected between the pressure source (60) and the hydraulic ram (51-52-53) for controllably extending and retracting the hydraulic ram (51-52-53) in an automatic mode;

a controller (3) for receiving and storing a base reference signal from the position sensor (7,8-9-10) corresponding to a preselected displacement of the hydraulic ram (51-52-53) in a manual mode, for selectively receiving the active signal when the hydraulic ram (51-52-53) is displaced away from said preselected displacement in the automatic mode, and for selectively controlling the electrically operated control valve (12-13-14) to return the hydraulic ram (51-52-53) to said preselected displacement; and a valve (15-70) for selectively changing the hydraulic pressure from one of said control valves (19-20-21-12-13-14) to the other to change between said modes.

10. An automatic implement position control system as recited in claim 9, wherein the work implement (40) is a bulldozer blade (40), and wherein there are a plurality of hydraulic rams (51,52,53) for lifting, tilting, and angular movement of the blade (40).

* * * * *